United States Patent [19]

Daeninckx et al.

[11] 3,943,582

[45] Mar. 16, 1976

[54] HOLDER FOR ADDITIVE TO FLUSHING WATER

[75] Inventors: Jean Daeninckx; Pierre Lelaquet, both of Paris, France

[73] Assignee: L'Oreal, Paris, France

[22] Filed: Sept. 12, 1974

[21] Appl. No.: 505,269

[30] Foreign Application Priority Data

Sept. 21, 1973 France ..... 73.33967

[52] U.S. Cl. ..... 4/227; 4/228; 23/267 A

[51] Int. Cl.[2] ..... E03D 9/03

[58] Field of Search ..... 4/222–224, 4/227, 228; 23/267 A

[56] References Cited

UNITED STATES PATENTS

| | | | |
|---|---|---|---|
| 2,807,807 | 10/1957 | Harper | 4/228 |
| 3,121,236 | 2/1964 | Yadro et al. | 4/228 |
| 3,604,020 | 9/1971 | Moisa | 4/228 |

*Primary Examiner*—Richard E. Aggerter
*Assistant Examiner*—Frederick R. Schmidt
*Attorney, Agent, or Firm*—Brisebois & Kruger

[57] ABSTRACT

Holder for additive to flushing water is provided with deflector opposite its water inlet for directing incoming water against the surface of the additive.

11 Claims, 3 Drawing Figures

HOLDER FOR ADDITIVE TO FLUSHING WATER

SUMMARY OF THE INVENTION

It is conventional practice to introduce into the tanks of flush toilets products which may simultaneously serve several different purposes, for example, that of attractively coloring the flushing water, that of having an anti-scale forming effect and that of producing a foam having a certain efficacity in the cleaning of the toilet bowl. The quantity of water stored in the flushing tank is substantially constant and it is desirable to deliver, each time the toilet is flushed, a substantially constant quantity of the additive so as to obtain a constant effect so long as the container holding the additional product is not empty.

It has already been proposed that the additive be located inside a container which is placed in the flushing tank, said container being immersed in the water within the tank when the tank is full and being provided with a water inlet orifice and a hole permitting the escape of air therefrom. When the tank is full the container holding the water soluble additive in solid form is filled with water, and when the toilet is flushed the water which has penetrated into the container and dissolved a part of the additive escapes from the container and mixes with the flushing water.

It has been found that with devices of the known type, while the additive dissolves satisfactorily at the beginning of use of a container holding the additive, there is a rapid decrease in the percentage of dissolution of the additive at each flushing of the toilet, which results in a decrease in the effect of the additive introduced into the volume of water ejected from the tank. Moreover, for the greater part of known containers, the aforesaid decrease amounts to a total absence of dissolution of the additive at a time when there nevertheless remains inside the container a by no means negligible part of the initial supply of this additive. This remaining part must therefore be thrown away with the container which has ceased to be effective and this results in a waste of additive which substantially increases the cost to the user.

It is the purpose of the present invention to provide a container for holding a soluble additive which is to be progressively dispensed as water is flushed, said container making it possible to avoid the above disadvantages and, in particular, insuring a substantially constant rate of dissolution of the additive each time the toilet is flushed until the additive within the container has been substantially completely consumed. It is obvious that the container according to the invention may be utilized not only when water is to be flushed, but also whenever it is desired to distribute within a given volume of liquid any additive which is soluble in that liquid.

It is therefore an object of the present invention to provide as a new article of manufacture a container adapted to enclose an additive which is to be progressively dissolved in water to be flushed, said container being immersed in the tank in which the flushing water is retained, and holding in its lower part the additive to be dissolved, while comprising an input orifice for flushing water above the additive, and an air outlet orifice in its upper part permitting the container to be filled by the flushing liquid, the level of the inlet orifice lying between the maximum and minimum levels of the flushing water in the tank.

Means are positioned opposite the inlet orifice for directing the liquid toward the free surface of the additive, said means nevertheless leaving a passage between its lower edge and the initial maximum level of the additive in the container. This device is characterized by the fact that the means directing the liquid toward the free surface of the additive is a deflector attached to the inside of the container and defining a vertical passage between it and the wall of said container, said deflector being positioned opposite the input orifice in the longitudinal median zone of one of the major surfaces of the container.

In a preferred embodiment of the invention, the container has the general shape of a prism and, in particular of a rectangular prism holding the additive up to about half its height. The air outlet orifice of the container is formed in a cover placed at the top of the container. The deflector defines a vertical passage the axis of which is substantially parallel to the major axis of the container. The wall of the vertical passage defined by the deflector is arcuate in transverse section, with the ends of the arc bearing against the surface of the container which defines the liquid inlet orifice. The deflector is held against the surface of the container which carries the liquid inlet orifice by a projection bearing on the opposite surface of the container, which may be centered in a hole in said opposite surface. The deflector extends upward toward the cover of the container. The additional product fills the container to between 30 and 60 percent of its total height. If s represents the cross-section of the container and S the total lateral surface of the container, the ratio $S/s$ lies between 1 and 20 and preferably between 2 and 10. The maximum width of the passage defined by the deflector, measured in the direction of the thickness of the container lies between 0.2 and 0.5 times the thickness of the container. The liquid inlet orifice is a substantially circular orifice, the diameter of which lies between 0.02 and 0.10 times the height of the container, the center of said orifice being spaced above the maximum upper level (that is to say the initial level) of the additive by a distance between 0.07 and 0.35 times the height of the container. The lower edge of the deflector is positioned at a distance between 0.05 and 0.25 times the height of the container from the center of the liquid inlet orifice.

In an alternative embodiment of the invention the lower edge of the wall constituting the deflector may not be parallel to the initial upper plane of the additive in the container but may have a particular shape, for example a V shape at the bottom. This type of surface may, in certain cases, increase the turbulence of the liquid penetrating inside the container. It has been found that the container according to the invention makes it possible to obtain a progressive dissolution of the additive in the container and makes it possible to introduce into the flush water for a toilet bowl a small quantity of the additive at each flushing until the complete exhaustion of the additive contained in the container. This particularly favorable result is due to the fact that the deflector inside the container directs the current of water which enters the container at each filling of the tank against the additive thus facilitating the dissolution of the product, regardless of the upper level of the product in the container, that is to say regardless of the number of previous uses of the container. Likewise, at each emptying of the tank, the water which has filled the container escapes therefrom through the water inlet and the presence of the deflector also imparts to this current of water leaving the container a movement in the direction of the additional product within the container which also facilitates dissolution of this product.

The container according to the invention may advantageously be made from a molded plastic material. The container may have a hook permitting it to be suspended inside the flushing tank. The deflector may be molded from plastic material. The water soluble additive within the container may be a hot poured mixture containing, for example, a dye and a foaming product.

In order that the object of the invention may be better understood, a preferred embodiment thereof will now be described, purely by way of illustration and example, with reference to the accompanying drawings, on which:

Figure 1:
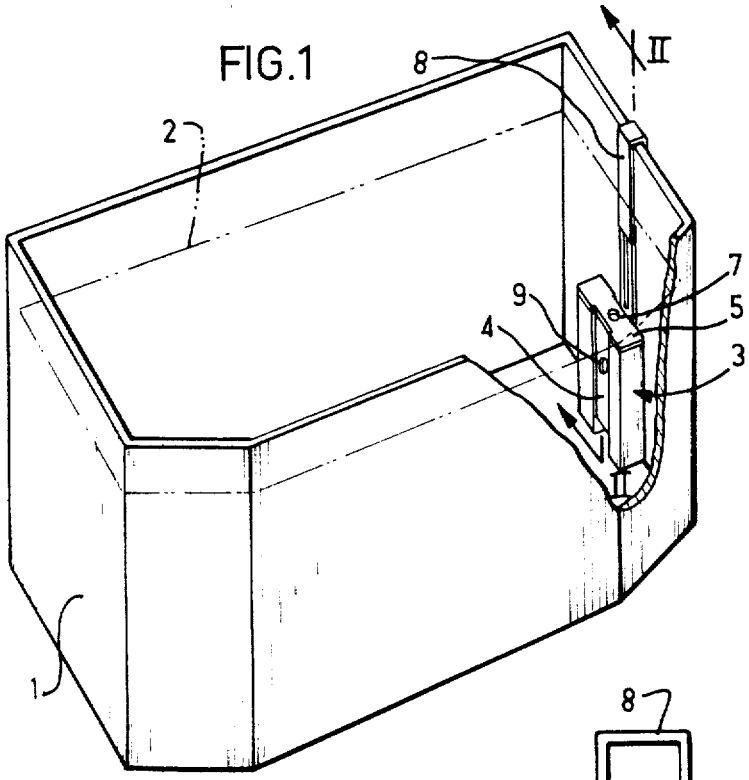
FIG. 1 shows a tank for a flush toilet containing a container according to the invention with part of the wall of the tank shown broken away.
Figure 2:
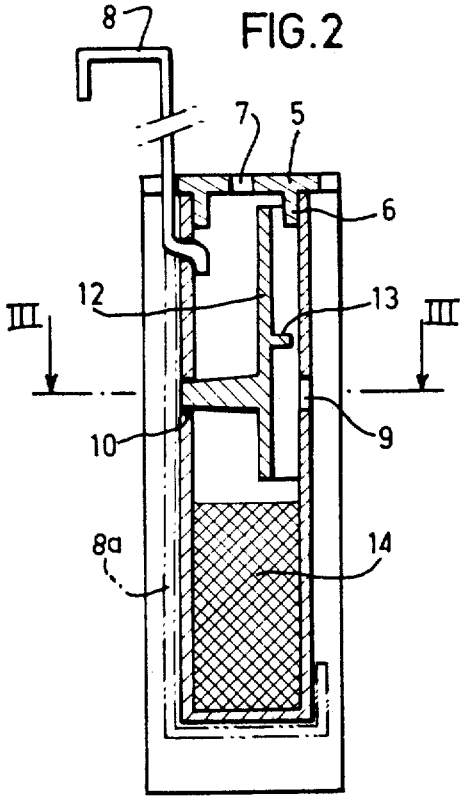
FIG. 2 is a sectional view of the container taken along the line II—II of FIG. 1.

Referring now to the drawing it will be seen that reference numeral 1 indicates a flushing tank in which the maximum upper level of the water is represented by the broken line 2. Inside this tank is mounted the container 3 according to the invention. The container 3 has the general shape of a parallelopiped. It consists of a box made of a molded plastic material 112 mm in height and 70 mm wide. The box is slightly reduced in thickness between the central strips 4 in its major surfaces. The thickness of the container 3 is about 24 mm, except between the strips 4. The container is closed at its upper end by a cover 5 carrying a flange 6 which fits into the top of the container. The cover 5 defines at its center an air outlet orifice 7. The container 3 is hooked onto the upper part of the tank by means of a hook 8 which, when the container is not in use, may be swung into the position shown in broken lines on FIG. 2 indicated by reference numeral 8*a*.

Figure 3:
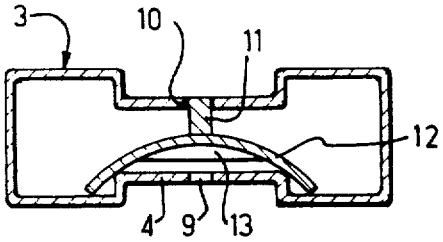
FIG. 3 is a sectional view taken along the line III—III of FIG. 2.

In the central zone of the strip 4 of one of the two major surfaces the container 3 has a circular orifice 9 which constitutes the water inlet orifice of the container. Opposite the orifice 9 is an orifice 10 inside of which is positioned the projection 11 of the deflector 12. The deflector 12 has an arcuate section and its two ends rest on the major surface of the container 3 which carries the orifice 9. The projection 11 is slightly conical and its end is introduced into the orifice 10 by taking advantage of the elasticity of the wall in which this orifice is formed. The edges of the deflector 12 rests against the wall which defines the orifice 9 by reason of the elastic deformation required to introduce the deflector into the container. The deflector 12 has a stiffening rib 13 positioned midway thereof. 73 grams of a water soluble additive 14 containing a dye and a foaming product has been poured into the lower part of the container 3. The diameter of the orifice 9 is 6 mm. The radius of curvature of the transverse section of the deflector 12 as it appears in FIG. 3 is 20 mm. The distance between the axis of the orifice 9 and the lower surface of the deflector 12 is 15 mm. The approximate distance between the lower surface of the deflector 12 and the maximum level attained by the additive 14 poured into the container is 5mm.

It has been found that the container which has just been described makes it possible to dissolve in the water in the tank 1 a certain quantity of the additive 14 which mixes with the water each time the tank is flushed. As the tank is refilled, when the level of the water reaches the level of the orifice 9 water enters the container 3 and the current of water is directed by the deflector 12 in the director of the additive 14. As the container 3 is filled there is consequently a progressive dissolution of the additive 14 due to the directional effect of the deflector 12. It should be noted that, in the absence of the deflector 12, the dissolving effect takes place only if the upper level of the additive 14 is sufficiently close to the orifice 9 and that when about half the additive 14 has been dissolved no further dissolution results so that the flushing water remains substantially colorless and non-foaming. On the contrary, the presence of the deflector 12 makes it possible to assure dissolution until complete exhaustion of the additive 14 from the container 3.

At the moment of flushing the water within the tank 1 above the additive 14 leaves the container so that the level of the water in the container 3 attains the level of the lower part of the orifice 9. During this emptying of the container 3 the presence of the deflector also forces the liquid to come into contact with the free surface of the water soluble additive 14 which facilitates its dissolution regardless of the position of the level of this free surface with respect to the bottom of the container 3.

It will of course be appreciated that the embodiment which has just been described has been given purely by way of illustration and example and may be modified as to detail without thereby departing from the basic principles of the invention. In particular, the lower part of the deflector 12 may be V-shaped with the point of the V downward, the container may be cylindrical, and the deflector may be carried by the cover.

What is claimed is:

1. In a container for holding an additive which is to be progressively dissolved in flushing water when said container is immersed in a tank in which the flushing water is held, said container having a removable cover defining an outlet orifice therein, a water inlet orifice between said container's top and bottom, means for positioning said container in said tank with said inlet between the maximum and minimum levels of the water in said tank, and a supply of additive in said container beneath said inlet, the improvement which comprises a deflector positioned within said container in alignment with and opposite said inlet, with said deflector's lower edge above the upper surface of said additive, said deflector degining, between it and the wall of said container in which said inlet is formed, a vertical passage extending from a first open end above said inlet to a second open end below said inlet, through which passage water entering through said inlet is deflected by said deflector against said upper surface of said additive, said passage having a cross-sectional dimensions parallel to said wall which is substantially greater than the width of said inlet.

2. Container as claimed in claim 1 which is generally prismatic in shape.

3. Container as claimed in claim 2 which has the shape of a prism having a rectangular base with said additive filling said container to about half its height.

4. Container as claimed in claim 1 in which the outlet orifice is formed in a separable cover at the top of the container.

5. Container as claimed in claim 1 in which the deflector defines a general vertically passage parallel to the major axis of the container between said deflector and on adjacent container wall.

6. Container as claimed in claim 5 in which the deflector has a transverse section of arcuate shape with the ends of the arc bearing against the wall of the container which defines the inlet orifice.

7. Container as claimed in claim 5 in which the maximum width of the generally vertical passage defined between the deflector and said wall, measured in the direction of the thickness of the container, lies between 0.2 and 0.5 times the thickness of the container.

8. Container as claimed in claim 1 in which the deflector is urged against the wall of the container which carries the inlet orifice by a projection bearing against the opposite wall of the container and centered in a hole in said opposite wall.

9. Container as claimed in claim 1 in which the height to which the additive initially fills the container lies between 30 and 60 percent of the total height of the container.

10. Container as claimed in claim 1 in which the ratio between the cross-sectional area of the container and the total lateral surface of the container lies between 1 and 20 and preferably between 2 and 10.

11. Container as claimed in claim 1 in which the inlet orifice is a substantially circular orifice the diameter of which lies between 0.02 and 0.10 times the height of the container, the center of said orifice being located at a distance between 0.07 and 0.35 times the height of the container above the maximum level of additive in said container, the lower edge of the deflector being positioned at a distance between 0.05 and 0.25 times the height of the container away from the center of the inlet orifice.

* * * * *